US007578700B2

(12) United States Patent
Xiong et al.

(10) Patent No.: US 7,578,700 B2
(45) Date of Patent: Aug. 25, 2009

(54) ELECTRICAL CONNECTOR WITH SUPPRESSED CROSSTALK

(75) Inventors: Feng Xiong, Kunshan (CN); Hong-Qiang Han, Kunshan (CN); Lun-Song Hu, Kunshan (CN); Zi-Qiang Zhu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/220,499

(22) Filed: Jul. 24, 2008

(65) Prior Publication Data

US 2009/0029600 A1 Jan. 29, 2009

(30) Foreign Application Priority Data

Jul. 24, 2007 (CN) ..... 2007 2 0040971 U

(51) Int. Cl.
*H01R 13/648* (2006.01)

(52) U.S. Cl. ..... 439/607; 439/606; 439/722; 439/941

(58) Field of Classification Search ..... 439/79, 439/606, 607, 626, 638, 722, 941
See application file for complete search history.

(56) References Cited

U.S. PATENT DOCUMENTS 6,142,833 A * 11/2000 Zhu et al. ..... 439/638
6,350,134 B1 * 2/2002 Fogg et al. ..... 439/79
6,461,173 B1 * 10/2002 Mizuno et al. ..... 439/79
6,540,559 B1 * 4/2003 Kemmick et al. ..... 439/608
6,814,612 B1 * 11/2004 Hu et al. ..... 439/541.5
6,863,569 B2 * 3/2005 Zhu et al. ..... 439/607
7,025,632 B2 * 4/2006 Hu et al. ..... 439/606
7,044,790 B2 * 5/2006 Zhu et al. ..... 439/607
7,410,367 B2 * 8/2008 Hashim et al. ..... 439/76.1
7,410,390 B2 * 8/2008 Watanabe et al. ..... 439/607
7,435,107 B2 * 10/2008 Masumoto et al. ..... 439/79
7,500,876 B2 * 3/2009 Chang ..... 439/607.01
2007/0066115 A1 3/2007 Saito et al.
2009/0023338 A1 * 1/2009 He et al. ..... 439/607
2009/0029567 A1 * 1/2009 Yi ..... 439/66
2009/0029575 A1 * 1/2009 Xiong et al. ..... 439/83
2009/0029600 A1 * 1/2009 Xiong et al. ..... 439/676

* cited by examiner

*Primary Examiner*—James Harvey
(74) *Attorney, Agent, or Firm*—Wei Te Chung

(57) ABSTRACT

An electrical connector (1) includes a contact case (2). A plurality of contacts (3) are retained in the contact case (2). The contacts (3) comprise a group of first contacts (311) and a group of second contacts (321). Each first and second contact (311, 321) has a body portion (313), a contact portion (314) and a soldering portion (315) extending from two ends of the body portion (313). The body portion (313) has a first bending portion (3131) joined with the contact portion (314), and a second bending portion (3132) joined with the soldering portion (315). A metal shield (4) encloses the contact case (2). Wherein the first bending portions (3131) of the first contacts (311) and the second contacts (321) are located at inside of the contact case (2). The distance between the first bending portion (3131) and the second bending portion (3132) of the second contact (321) is larger than that of the first contact (311).

13 Claims, 11 Drawing Sheets

ELECTRICAL CONNECTOR WITH SUPPRESSED CROSSTALK

BACKGROUND OF THE INVENTION

1. Field of the Invention

The present invention relates to an electrical connector, and more particularly to electrical connectors with suppressed crosstalk.

2. Description of Related Art

With rapid development of the electrical industry, signal transmission between different peripherals are increased at the same time, especially between electrical connector. An electrical connector usually comprises an insulative housing with a plurality of contact passageways and a plurality of contacts retained therein. The number of the contacts is usually increased for increasing the signal transmission between electrical connectors. However, as the electrical connector trends to a miniature direction, the distance between adjacent contacts is decreased less and less. Crosstalk between adjacent contacts is increased.

In order to solving above problem, we will think to increase the distance between adjacent contacts for decreasing the crosstalk of the contacts. The contacts would be arranged in two rows. Each contact usually has a securing portion engaging with the contact passageway for fixing the contact therein, a contact portion extending forwardly from the securing portion, a soldering portion connecting with a circuit board, and a connection portion between the securing portion and the soldering portion. The securing portions are arranged in two rows along a front to back direction which comprises a first row close to the insulative housing and a second row located between the first row. The securing portion is usually designed to have an appropriate length for fixing into the insulative housing firmly. The length of the contacts can not be increased because of the trends of miniature development. Thereby, the distance between the first row and the second row of the contacts would not be increased. The crosstalk between adjacent contacts would not be decreased all the same.

Hence, an electrical connector is desired to overcome the disadvantage of the prior art.

BRIEF SUMMARY OF THE INVENTION

According to one aspect of the present invention, an electrical connector comprises a contact case. A plurality of contacts are retained in the contact case. The contacts comprise a group of first contacts and a group of second contacts. Each first and second contact has a body portion, a contact portion and a soldering portion extending from two ends of the body portion. The body portion has a first bending portion joined with the contact portion, and a second bending portion joined with the soldering portion. A metal shield encloses the contact case. Wherein the first bending portions of the first contacts and the second contacts are located at inside of the contact case. The distance between the first bending portion and the second bending portion of the second contact is larger than that of the first contact.

According to another aspect of the present invention, an electrical connector comprises a contact case. A plurality of contacts are retained in the contact case. The contacts comprise a group of first contacts and a group of second contacts. Each first and second contact has a body portion, a contact portion and a soldering portion extending from two ends of the body portion. The body portion has a first bending portion joined with the contact portion, and a second bending portion joined with the soldering portion. A metal shield encloses the contact case. Wherein the first bending portions of the first contacts and the second contacts are enclosed by the contact case. The body portions of the second contacts and the first contacts are arranged in two rows along a front to back direction.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
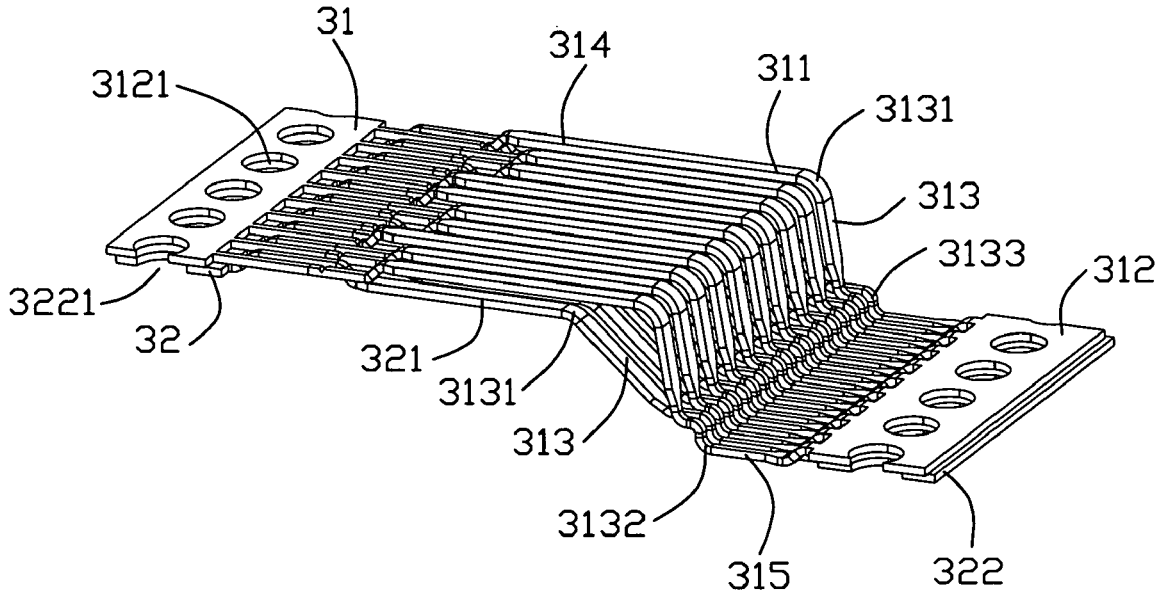
FIG. 1 is a perspective view of two contact carrier strips of an electrical connector according to one embodiment of the present invention.
Figure 2:
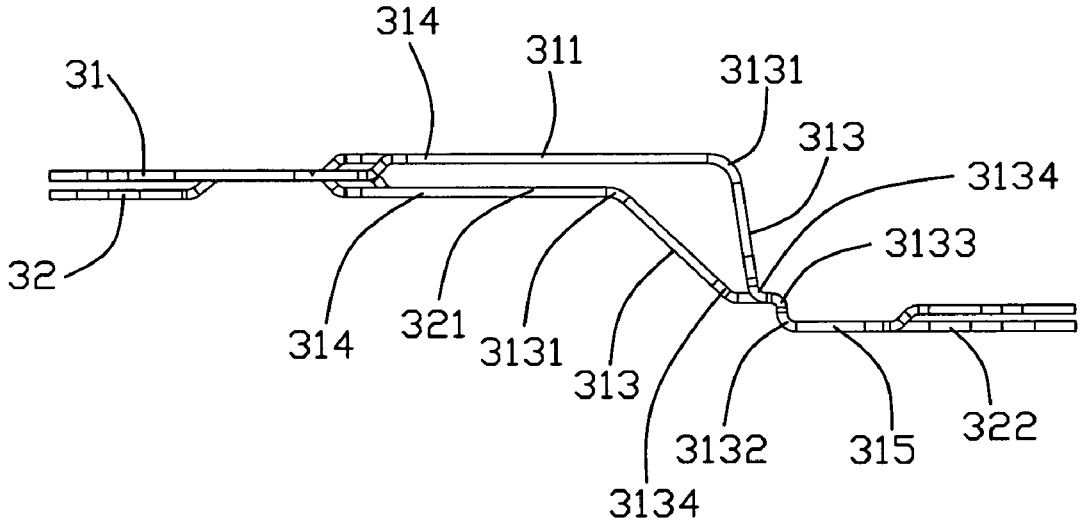
FIG. 2 is a left side elevational view of the FIG. 1.
Figure 3:
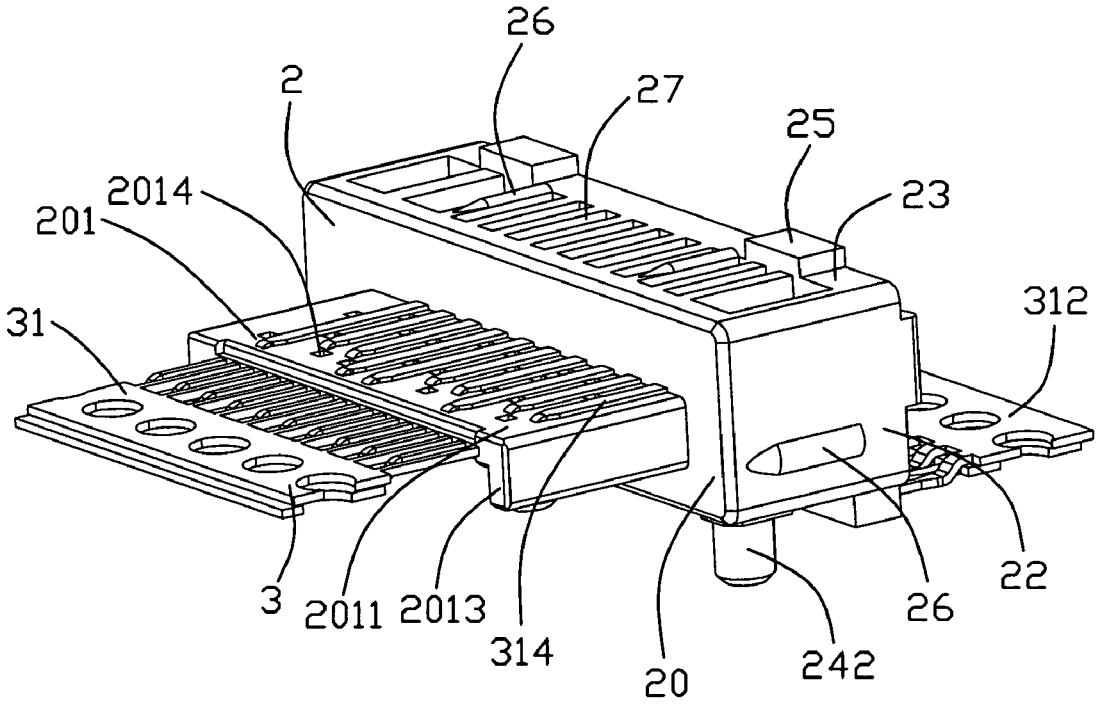
FIG. 3 is a perspective view of a contact case insert molded around the contact strips of the FIG. 1.
Figure 4:
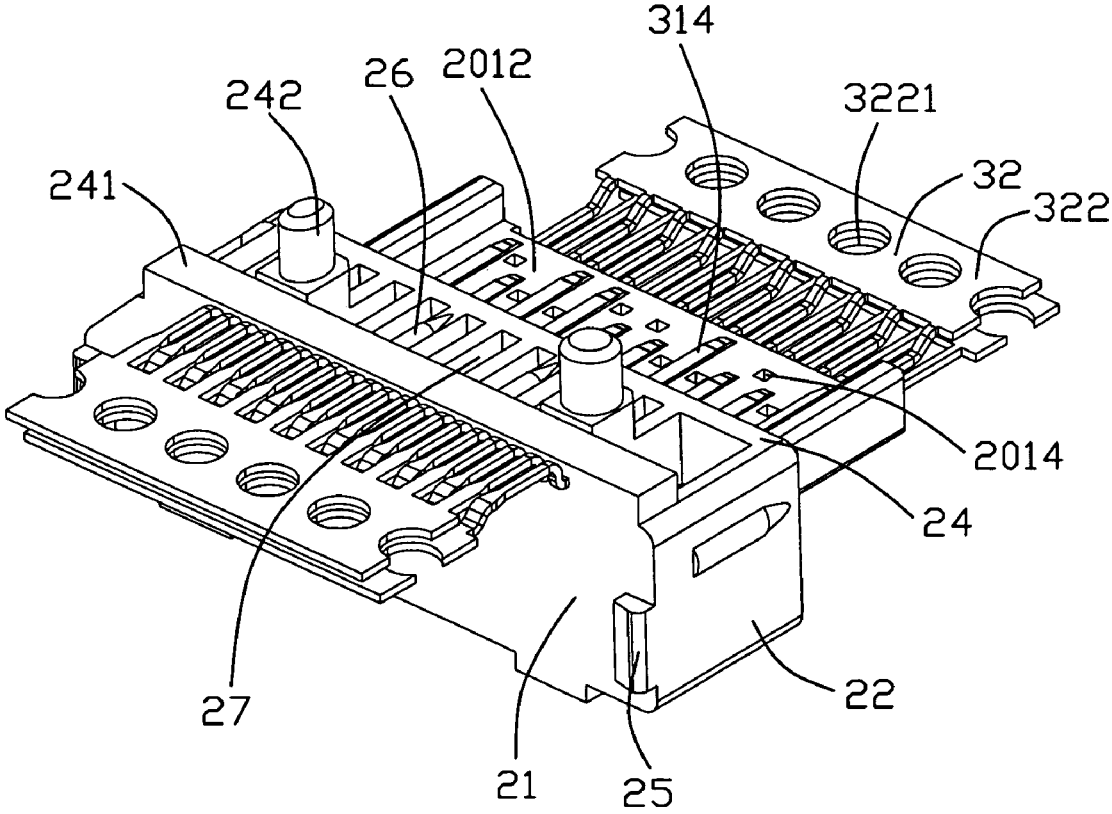
FIG. 4 is a view similar to FIG. 3, while taken from another aspect.
Figure 5:
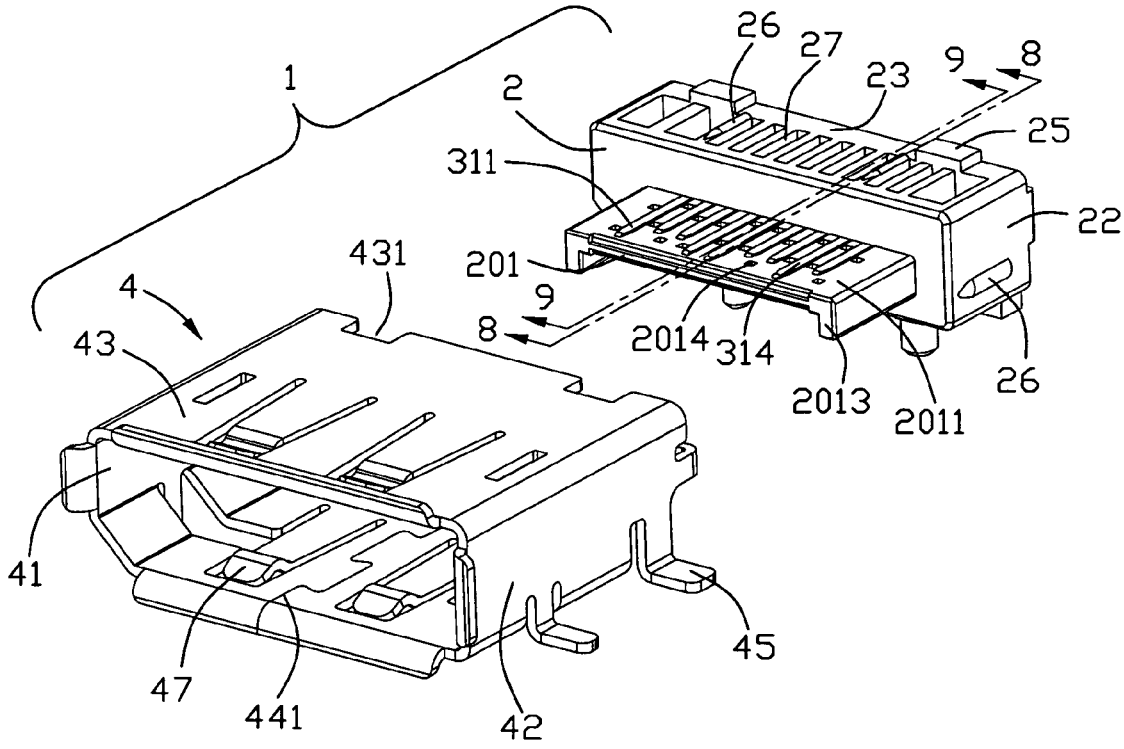
FIG. 5 is a partial exploded view of the electrical connector.
Figure 6:
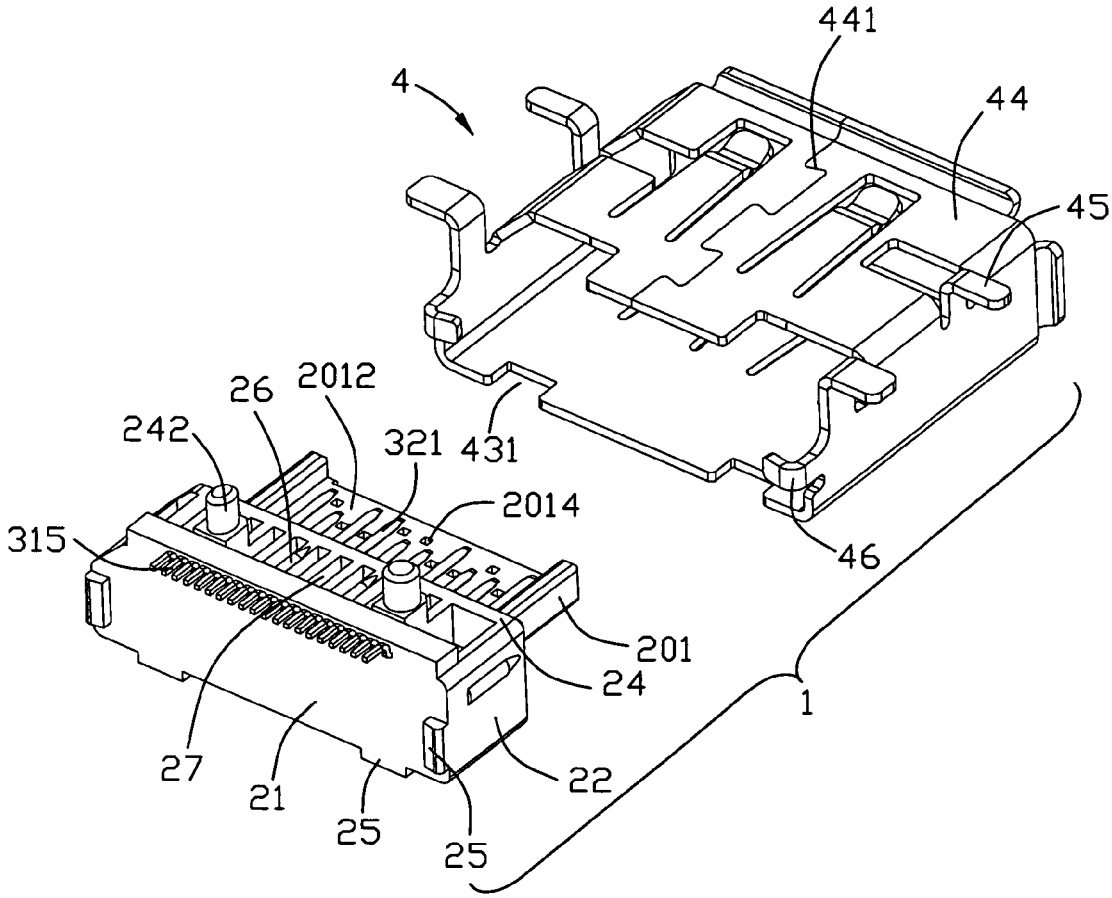
FIG. 6 is a view similar to FIG. 5, while taken from another aspect.
Figure 7:
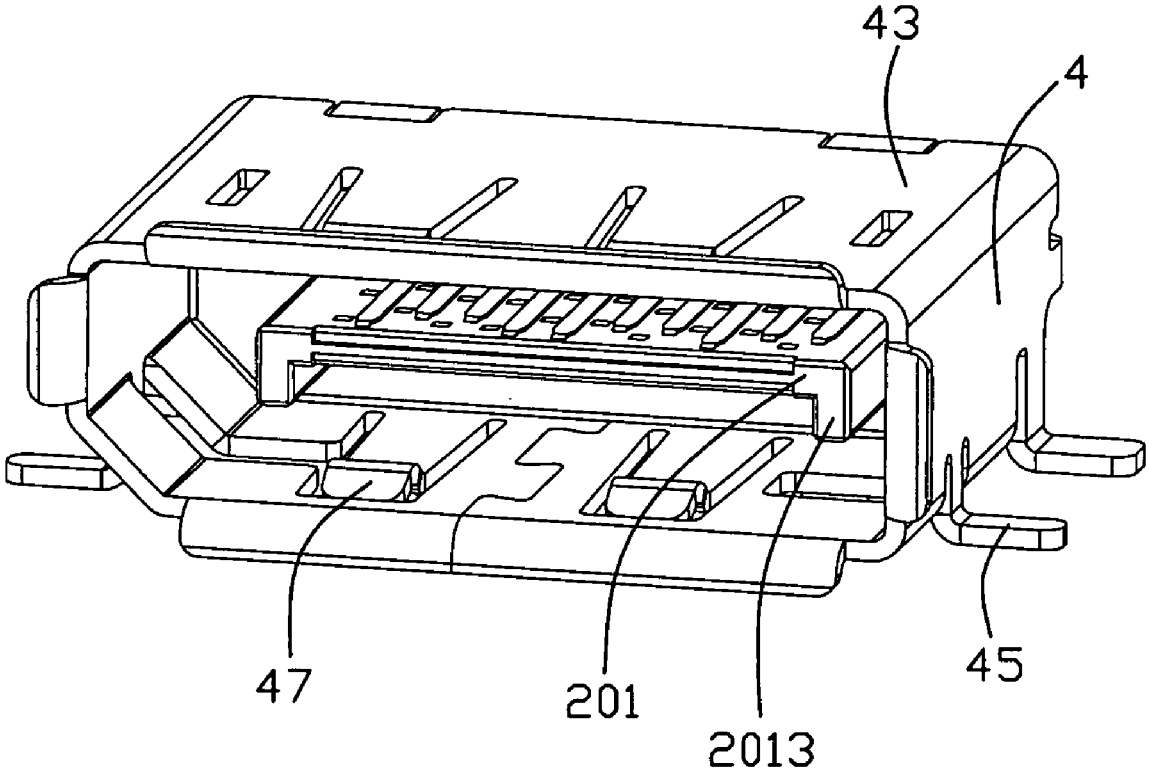
FIG. 7 is a perspective view of the electrical connector according to the present invention.
Figure 8:
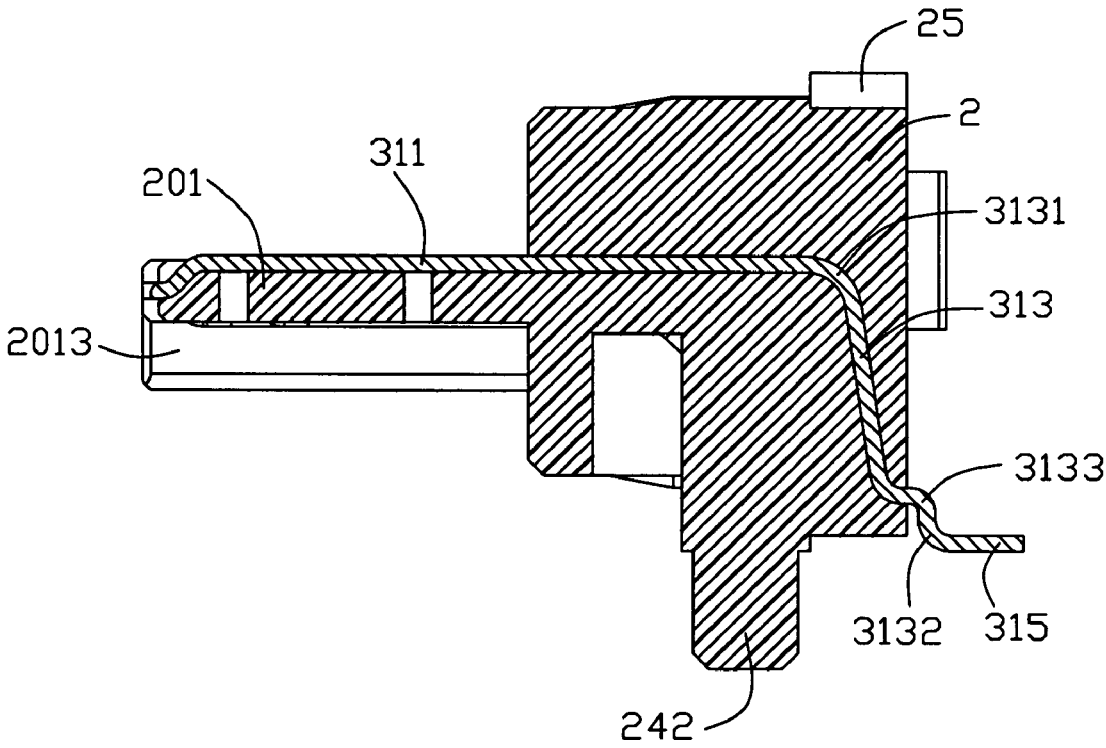
FIG. 8 is a cross-sectional view taken along line 8-8 of FIG. 5.
Figure 9:
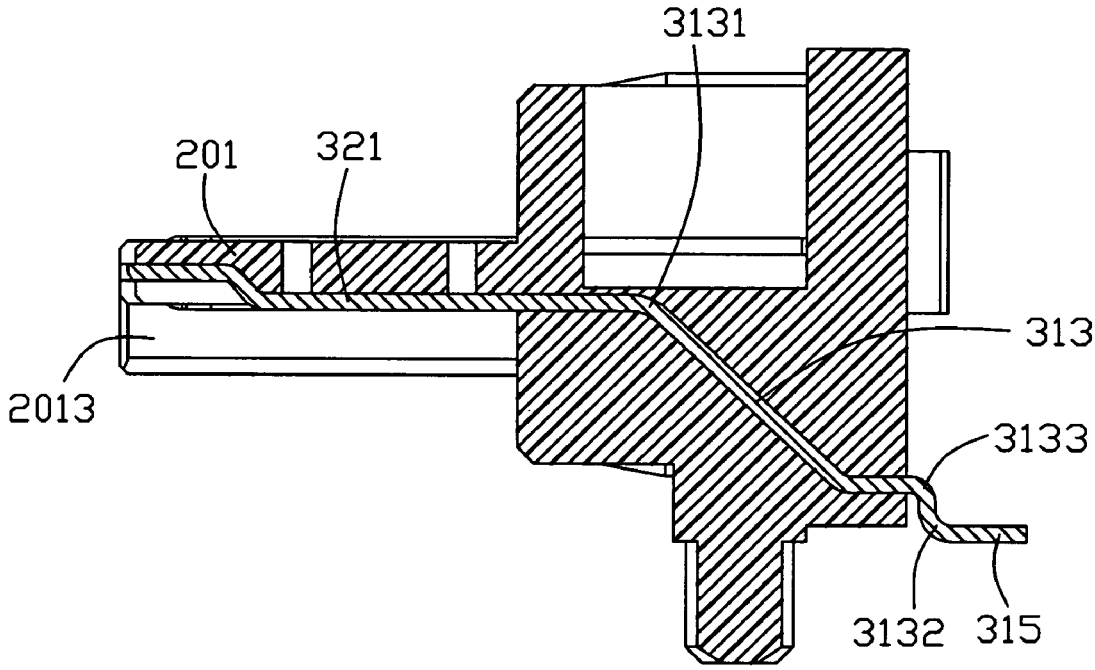
FIG. 9 is a cross-sectional view taken along line 9-9 of FIG. 5.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Referring to FIGS. 1-9, an electrical connector 1 for receiving a corresponding plug (not shown) is disclosed in accordance with the present invention. The electrical connector 1 comprises a contact case 2, a plurality of contacts 3 insert molded into the contact case 2, and a metal shield 4 enclosing the contact case 2.

The contact case 2 is insert molded around the contacts 3. The contact case 2 comprises a front face 20, a rear face 21, a pair of side wall 22, an upper wall 23 and a lower wall 24. A tongue plate 201 extends forwardly from the front face 20.

The tongue plate 201 presents as U-shaped and comprises an upper face 2011, a lower face 2012 and a pair of ribs 2013 extending downwardly from two sides thereof. The contact case 2 has a plurality of projection 25 extending outwardly from the upper wall 23 and the rear face 21 for abutting against the metal shield 4. The contact case 2 also comprises a plurality of protrusions 26 at the upper wall 23, lower wall 24 and side walls 22 for engaging with the metal shield 4. A pair of posts 242 extend downwardly from the lower wall 24 for fixing the electrical connector 1 on a circuit board (not shown).

The contacts 3 are stamped by two metal strips and insert molded into the contact case 2. The contacts 3 comprise a group of first contact carrier strip 31 and a group of second contact carrier strip 32. The first contact carrier strip 31 comprises a plurality of first contacts 311 and a pair of carriers 312 connected with two ends thereof. The second contact carrier strip 32 comprises a plurality of second contacts 321 and a pair of carriers 322 connected with two ends thereof. Each carrier 312, 322 defines a plurality of locking holes 3121, 3221 for fixing in a mold (not shown).

Each first and second contact 311, 321 has a body portion 313, a contact portion 314 extending forwardly from one end of the body portion 313, and a soldering portion 315 extending backwardly from another end of the body portion 313. The body portion 313 comprises a first bending portion 3131 joined with the contact portion 314, a second bending portion 3132 joined with the soldering portion 315, and a third bending portion 3133 between the first and second bending portions 3131, 3132 and near the second bending portion 3132. The contact portions 314 of the first contacts 311 are arranged at the upper face 2011 of the tongue plate 201 and exposed out of the upper face 2011. The contact portions 314 of the second contacts 321 are located at the lower face 2012 of the tongue plate 201 and exposed out of the lower face 2012. The first contacts 311 are staggered with the second contacts 321. The front ends of the contact portions 314 are arranged in one row and enclosed by the front end of the tongue plate 201. Thereby, the contact portions 314 would not turn up to ensure the coplanarity of the contacts 3.

The body portions 313 are arranged in two rows along the front to back direction, wherein the body portions 313 of the second contacts 321 are located at a front row close to the front end of the contact case 2, while the body portions 313 of the first contacts 311 are located at a rear row far from the front end of the contact case 2. The angle of the first bending portion 3131 of the second contact 321 is larger than the angle of the first bending portion 3131 of the first contact 311. The distance between the first bending portion 3131 and the second bending portion 3132 of the second contact 321 is larger than that of the first contact 311. The soldering portions 315 of the first and second contacts 311, 321 are arranged in one row and located at a common plane. The soldering portions 315 of the first and second contacts 311, 321 have the same length for soldering firmly on the circuit board.

The contacts 3 described in above specification are made by steps as follows. firstly, stamping the plurality of first and second contacts 311, 321 from two pieces of metal strip respectively, the contact portions 314, body portions 313 and soldering portions 315 of the first contacts 311 are located at a common plane at this time, and the contact portions 314, body portions 313 and soldering portions 315 of the second contacts 321 are located at another common plane at this time. The contact portions 314 of the second contacts 321 are shorter than that of the first contacts 311. Secondly, bending the first bending portions 3131 downwardly at a front portion of the body portions 313 of the first contacts 311, and bending other first bending portions 3131 downwardly at a middle portion of the body portions 313 of the second contacts 321, the angle of the first bending portion 3131 of the second contacts 321 is larger than that of the first contacts 311. Thirdly, bending the fourth bending portion 3134 backwardly at a lower portion of the body portion 313 of each first and second contact 311, 321, then the rear portion of the body portion 313 and the soldering portions 315 are all parallel to horizontal.

Fourthly, arranging the rear portion of the body portions 313 and the soldering portions 315 of first and second contacts 311, 321 in one row for fixing in a mold conveniently, then insert molding the contact case 2 there around. Fifthly, bending the third bending portion 3133 downwardly at a rear end of the body portion 313, the soldering portions 315 of all contacts 3 are located at a common upright plane. Finally, bending the second bending portions 3132 of the first and second contacts 311, 321 by one time, the second bending portions 3132 are adjacent to the third bending portions 3133. The second bending portions 3132 of the first and second contacts 311, 321 will be arranged at one row and located at a common arc face. All soldering portions 315 will be located at a common level plane to surface mounted to the circuit board. The coplanarity of all soldering portions 315 will be improved.

In process of making the electrical connector 1, firstly, fixing the contacts 3 in the mold by the locking holes 3121, 3221, the mold comprises a plurality of pins (not shown) pressing two sides of contact portions 314 along an up to down direction for preventing the contacts 3 from distorting. Thereby, the first and second contact carrier strips 31, 32 can be positioned by the mold firmly. The contacts 311, 321 will not contact with each other which will ensure the signal transmission of the electrical connector 1. Then filling melted insulative material into the mold, the mold comprises a plurality of posts (not shown) for promoting the movement of the insulative material. The contact case 2 will be formed after the insulative material freezing. Secondly, cut out the carriers 312, 322.

The contact case 2 is formed with a plurality of slots 27 at upper and lower positions corresponding to the posts of the mold. The tongue plate 201 is formed with a plurality of hollows 2014 extending through thereof and located at the position of the pins. The front ends of the first and second contacts 311, 321 are surrounded by the insulative material. The body portions 313 are enclosed by the insulative material. Thereby, the first bending portions 3131, and other portion between the first bending portions 3131 and the second bending portions 3132 are enclosed by the contact case 2. The first and second contacts 311, 321 are fastened in the contact case 2 firmly. Because the first and second bending portions 3131, 3132 are retained inside of the contact case 2. Therefore, the first bending portions 3131 of the second contacts 321 would be set close to the front face 20, while the first bending portions 3131 of the first contacts 311 would be set far from the front face 20. The distance of the body portions 313 between the first contacts 311 and the second contacts 321 would be increased. The crosstalk between the contacts 3 will be decreased. The second bending portions 3132 are located at outside of the contact case 2 and arranged in one row for making the soldering portions 315 in a common plane.

The metal shield 4 is stamped and bended by a metal sheet. The metal shield 4 comprises a left wall 41, a right wall 42, a top wall 43 and a bottom wall 44 and a receiving space (not labeled) there between. The bottom wall 44 is formed with a joined portion 441. Each top wall 43 and bottom wall 44 has a pair of spring arms 47 extending into the receiving space.

The left wall 41 and right wall 42 are anisomerous for preventing the corresponding plug from inserting mistakenly. The top wall 43 defines a pair of apertures 431 engaging with the projections 25 of the upper wall 23. Each left and right wall 41, 42 has a pair of mounting legs 45 extending outwardly and a locking barb 46 for locking with the projection 25 of the rear wall 21.

Figure 10:
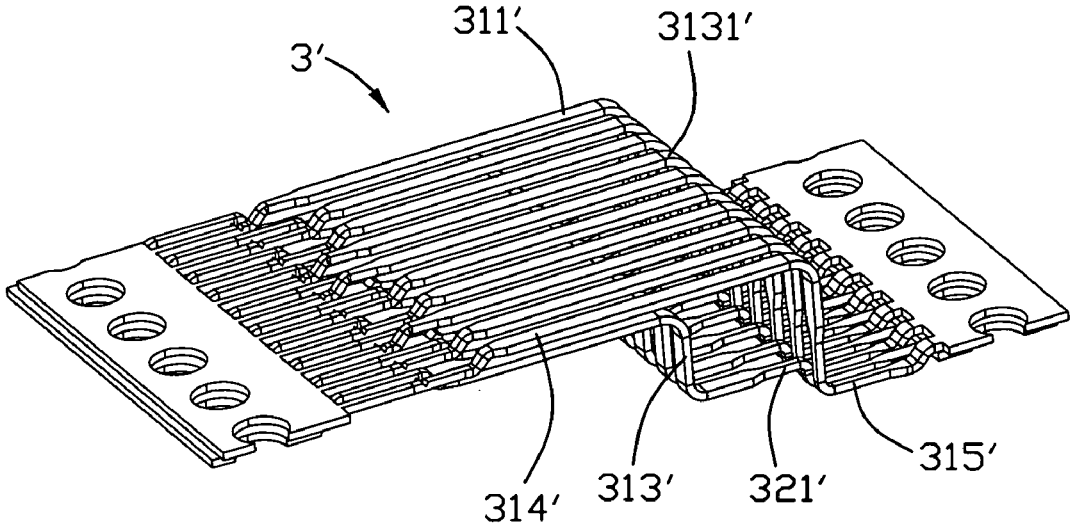
FIG. 10 is a perspective view of two contact carrier strips of an electrical connector according to another embodiment of the present invention.
Figure 11:
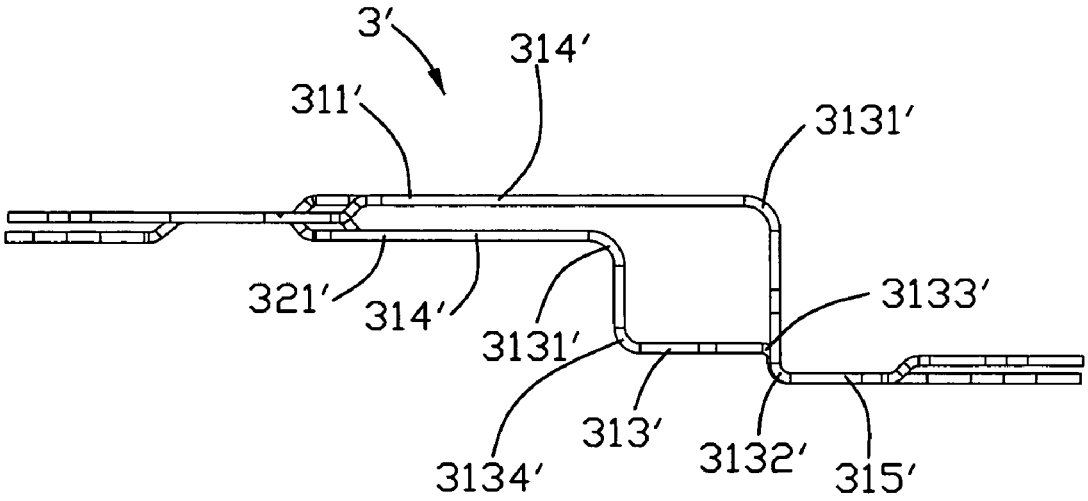
FIG. 11 is a left side elevational view of the FIG. 10.

Referring to FIGS. 10-11, another embodiment of the contacts 3' are displayed. The structure of the contacts 3' is approximately similar with above embodiment and insert molded in the contact case 2 by the same way. The contacts 3' comprise a group of first contacts 311' and a group of second contacts 321'. Each first and second contact 311', 321' has a body portion 313', a contact portion 314' and a soldering portion 315'. The body portion 313' has a first bending portion 3131' and a second bending portion 3132' also. The difference is that the angle of the first bending portion 3131' of the first contact 311' is same as that of the second contact 321'. The body portions 313' of the first contacts 311' has a vertical portion which is parallel to that of the second contacts 321' which can be decrease the crosstalk too. In addition, each second contact 321' has a fourth bending portion 3134' bending backwardly at a lower end of the vertical portion, and a third bending portion 3133' adjacent to the second bending portion 3132' for setting the second bending portions 3132' in a common arc face. All soldering portions 315' will be located at a common level plane to surface mounted to the circuit board. The coplanarity of all soldering portions 315' will be improved.

According to the present invention, the contact case 2 is insert molded around the contacts 3, 3' and fixed the contacts 3, 3' therein. Thereby the great mass of the body portion 313, 313' would be enclosed by the contact case 2. The first bending portions 3131, 3131' are retained in the contact case 2 too. In addition, the body portions 313, 313' of the contacts 3, 3' are arranged in two rows along the front to back direction. While the first bending portions 3131, 3131' of the second contacts 321, 321' would be set close to the front face 20, and the first bending portions 3131, 3131' of the first contacts 311, 311' would be set far from the front face 20. Therefore, the distance of the body portions 313, 313' between the first contacts 311, 311' and the second contacts 321, 321' would be increased. The crosstalk between the contacts 3, 3' will be decreased.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

The first bending portion 3131 is also referred to as a contact bend portion. The second bending portion 3132 is also referred to as a solder bend portion. The third bending portion 3133 is also referred to as a intermediate downward bend portion. The forth bending portion 3134 is also referred to as a intermediate body bend portion.

What is claimed is:

1. An electrical connector, comprising:

a contact case;

a plurality of contacts retained in the contact case, the contacts comprising a group of first contacts and a group of second contacts, each first contact and second contact having a body portion, a contact portion and a soldering portion extending from two opposite ends of the body portion respectively, the body portion having a contact bend portion joined with the contact portion, and a solder bend portion joined with the soldering portion; and a metal shield enclosing the contact case;

wherein the contact bend portions of the first contacts and the second contacts are located inside of the contact case, and wherein the distance between the contact bend portion and the solder bend portion of the second contact is larger than that of the first contact;

wherein an inside angle of the contact bending portions of the second contacts have an inside angle that is greater than an inside angle of the contact bending portions of the first contacts;

wherein each first contact and second contact has a intermediate body bending portion bending backwardly for setting the rear portions thereof in one row;

wherein each first contact and second contact has a intermediate downward bending portion between the intermediate body bending portion and the solder bending portion.

2. The electrical connector according to claim 1, wherein the contact case is insert-molded around the contacts.

3. The electrical connector according to claim 1, wherein the body portions of the second contacts and the first contacts are arranged in two rows along a front to back direction, and wherein the body portions of the second contacts are located at a front row close to a front end of the contact case, while the body portions of the first contacts are located at a rear row far from the front end of the contact case.

4. The electrical connector according to claim 1, wherein the solder bend portions of the first contacts and the second contacts are arranged in one row in a direction that is traverse to an insertion direction.

5. The electrical connector according to claim 4, wherein the first contacts and the second contacts are staggered with each other.

6. The electrical connector according to claim 1, wherein the contact case comprises a tongue extending forwardly, the contact portions of the first contacts exposed out of an upper face of the tongue, the contact portions of the second contacts exposed out of a lower face of the tongue and staggered with the first contacts along a height direction of the contact case.

7. The electrical connector according to claim 6, wherein contact case is formed with a plurality of slots at upper and lower positions thereof, and the tongue is formed with a plurality of holes corresponding to each contact.

8. The electrical connector according to claim 7, wherein a front end of each contact is enclosed by a front end of the tongue, the front ends of the contacts being arranged in one row.

9. The electrical connector according to claim 1, wherein the soldering portions of the contacts are arranged in a row at a common plane and have same length.

10. An electrical connector, comprising:

a contact case;

a plurality of contacts retained in the contact case, the contacts comprising a group of first contacts and a group of second contacts, each first contact and second contact having a body portion, a contact portion and a soldering portion extending from two opposite ends of the body portion respectively, the body portion having a contact bend portion joined with the contact portion, and a solder bend portion joined with the soldering portion; and a metal shield enclosing the contact case;

wherein the contact bend portions of the first contacts and the second contacts are enclosed by the contact case, and wherein the contact bending portions of the second contacts and contact bending portions of the first contacts are arranged in two rows along a front to back direction;

wherein an inside angle of the contact bending portions of the second contacts have an inside angle that is greater than an inside angle of the contact bending portions of the first contacts;

wherein each first contact and second contact has a intermediate body bending portion bending backwardly for setting the rear portions thereof in one row;

wherein each first contact and second contact has a intermediate downward bending portion between the intermediate body bending portion and the solder bending portion.

11. The electrical connector according to claim 10, wherein the contact case is insert molded around the contacts.

12. The electrical connector according to claim 11, wherein the contact bend portions of the second contacts are located at a front row close to a front end of the contact case, while the contact bend portions of the first contacts are located at a rear row far from the front end of the contact case.

13. The electrical connector according to claim 12, wherein the solder bend portions of the first and second contacts are arranged in one row in a direction that is traverse to an insertion direction.

* * * * *